US008303205B2

(12) United States Patent
Luo

(10) Patent No.: US 8,303,205 B2
(45) Date of Patent: Nov. 6, 2012

(54) LEAKPROOF MAKEUP APPLICATOR

(75) Inventor: Yun-Fa Luo, Taichung (TW)

(73) Assignee: Unit Japan Co. Ltd., Osaka (JP)

( * ) Notice: Subject to any disclaimer, the term of this patent is extended or adjusted under 35 U.S.C. 154(b) by 386 days.

(21) Appl. No.: 12/684,755

(22) Filed: Jan. 8, 2010

(65) Prior Publication Data

US 2011/0097135 A1 Apr. 28, 2011

(30) Foreign Application Priority Data

Oct. 23, 2009 (TW) ..... 98219627 U

(51) Int. Cl.
*A46B 11/00* (2006.01)

(52) U.S. Cl. ..... 401/126; 401/129; 132/218

(58) Field of Classification Search ..... 401/1, 126–130; 132/216–218
See application file for complete search history.

(56) References Cited

U.S. PATENT DOCUMENTS 3,756,731 A * 9/1973 Aubry ..... 401/122
7,481,592 B2 * 1/2009 Gueret ..... 401/129
8,001,981 B2 * 8/2011 Jeong et al. ..... 132/218
8,021,065 B2 * 9/2011 Lou ..... 401/129
8,091,560 B2 * 1/2012 Kim et al. ..... 132/217
2009/0272395 A1 * 11/2009 Carey ..... 132/200
2011/0100866 A1 * 5/2011 Gueret ..... 206/581

FOREIGN PATENT DOCUMENTS

WO WO 2007029988 A1 * 3/2007

* cited by examiner

*Primary Examiner* — David Walczak
*Assistant Examiner* — Jennifer C Chiang

(57) ABSTRACT

A leakproof makeup applicator includes a main body, a rod, a collar and a bottle. The main body defines a receiving space therein. A power supply, a motor and a connector are disposed in the receiving space. The power supply electrically connects to the motor, and the connector is driven by the motor to be rotatable with respect to the main body. The rod connects to the connector concentrically and has a sealing sleeve disposed thereon. The bottle defines a liquid chamber and an opening formed at one end thereof. The opening has a plastic ring disposed on its inner periphery, in which the plastic ring defines a through hole. The rod inserts into the liquid chamber via the through hole. The sealing sleeve seals the through hole as the bottle and the collar are threadedly combined with each other.

6 Claims, 5 Drawing Sheets

LEAKPROOF MAKEUP APPLICATOR

BACKGROUND OF THE INVENTION

1. Field of the Invention

The present invention relates to a makeup applicator, and more particularly to a leakproof makeup applicator.

2. Description of the Prior Art

Some conventional makeup applicators have rotatable rods with applicator heads attached thereon, so as to facilitate the users to finish the makeup more efficiently.

One of the disadvantages of the above mentioned makeup applicators is that the makeup liquid mixture is adapted to fill the gaps between the rod and the shell or other nonrotatable elements and is eventually coagulated, so that the rod is deprived of the rotational function. Moreover, such malfunction is usually unrepairable, thus causes much trouble to the users.

The present invention is, therefore, arisen to obviate or at least mitigate the disadvantages mentioned hereinabove.

SUMMARY OF THE INVENTION

The main object of the present invention is to provide a leakproof makeup applicator.

To achieve the above and other objects, the leakproof makeup applicator of the present invention includes a main body, a rod and a bottle. The main body defines a receiving space therein. A power supply, a motor and a connector are disposed in the receiving space. The power supply electrically connects to the motor, and the connector is driven by the motor to be rotatable with respect to the main body. The rod has a first end and a second end. The first end is connected to the connector concentrically, and the second end is disposed with an applicator head. The rod further has a sealing sleeve disposed thereon. The bottle defines a liquid chamber and an opening formed at one end thereof. The rod inserts into the liquid chamber via the opening, and the sealing sleeve seals the opening as the bottle and the main body are combined with each other.

Thereby, the makeup liquid mixture in the liquid chamber will not leak to fill gaps between the rotatable elements, such as the rod and the connector, and the nonrotatable elements, such as the main body, so as to prevent malfunction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
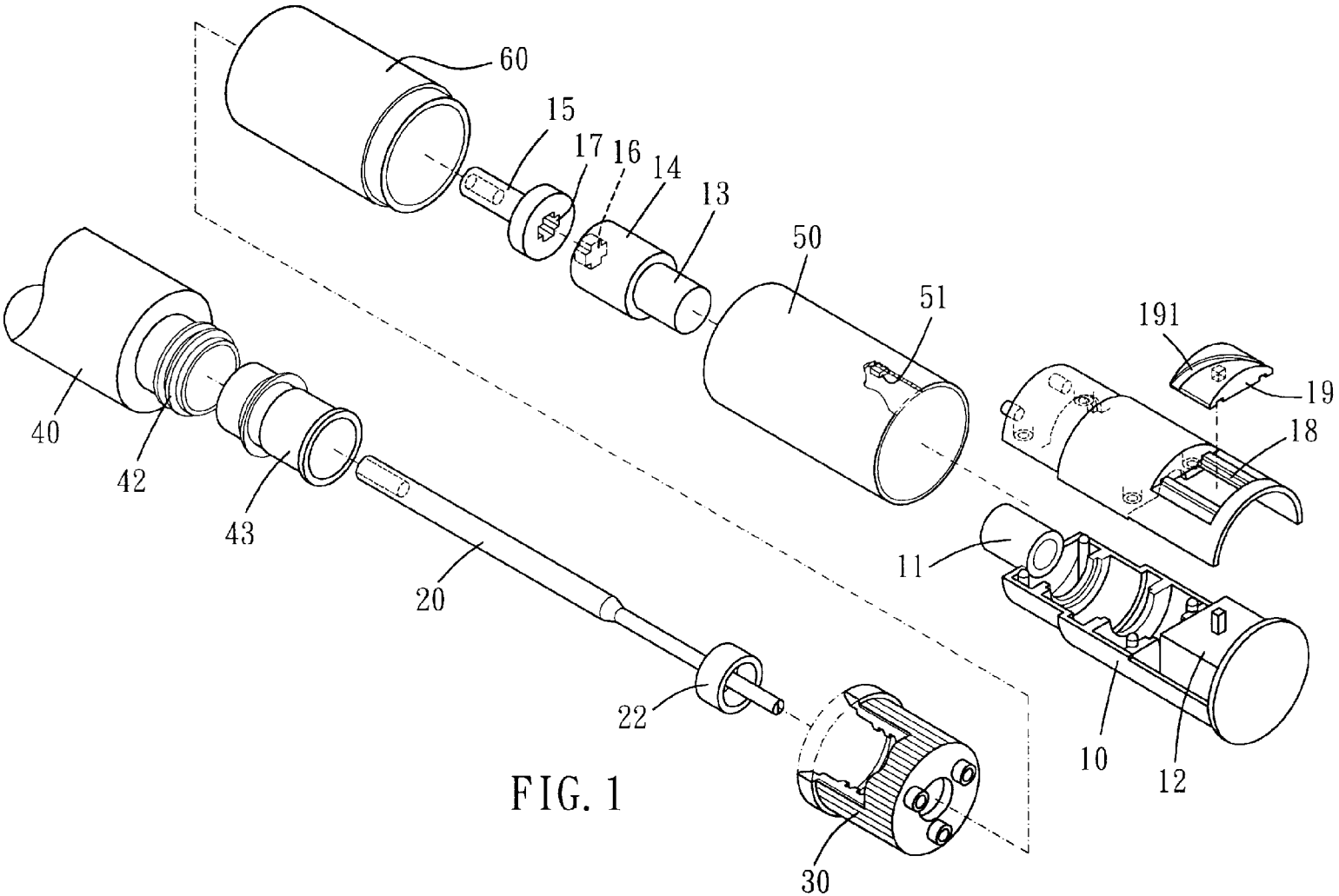
FIG. 1 is a breakdown drawing showing a makeup applicator in accordance with a first embodiment of the present invention.
Figure 2:
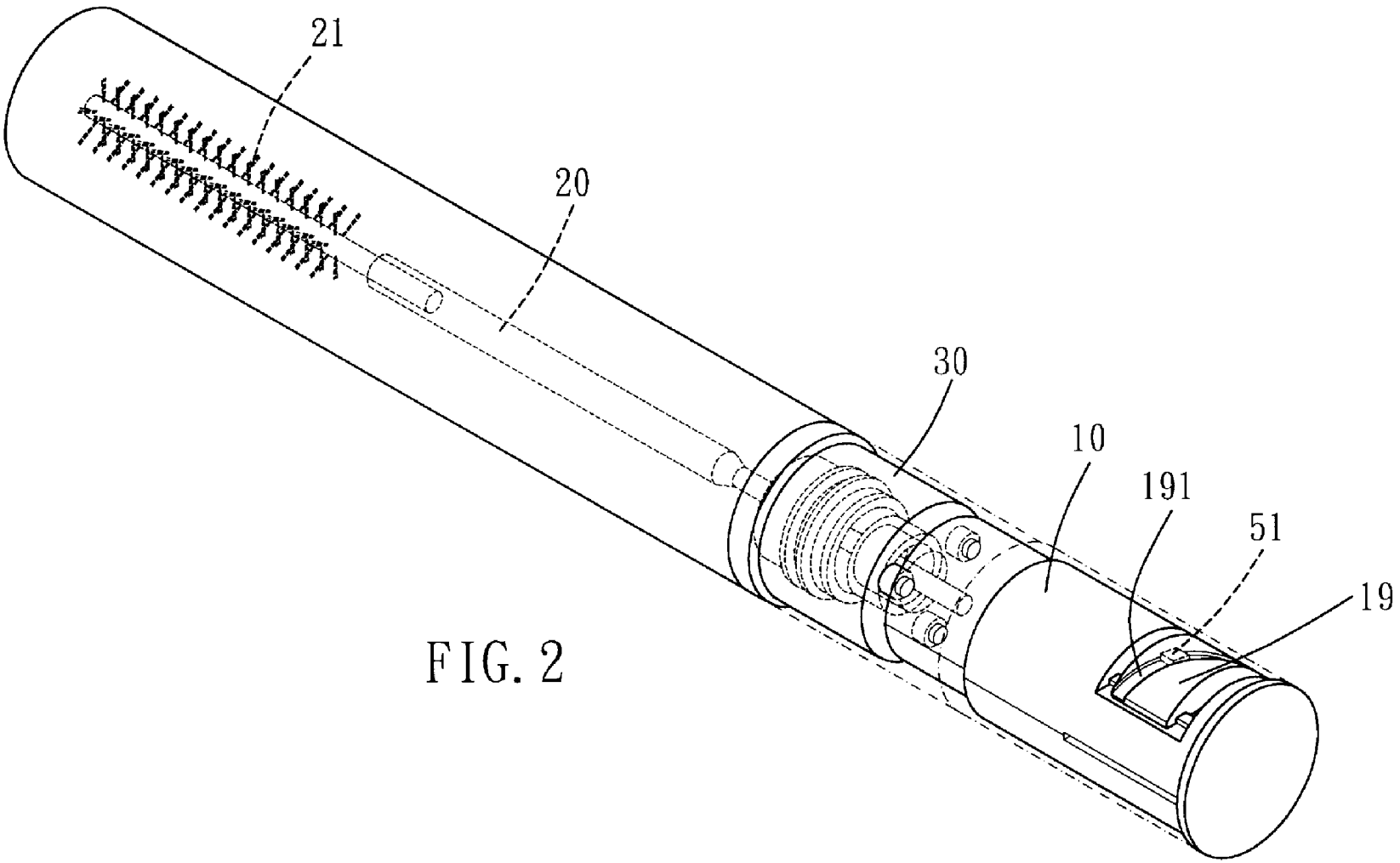
FIG. 2 is a perspective drawing showing a makeup applicator in accordance with a first embodiment of the present invention.
Figure 3:
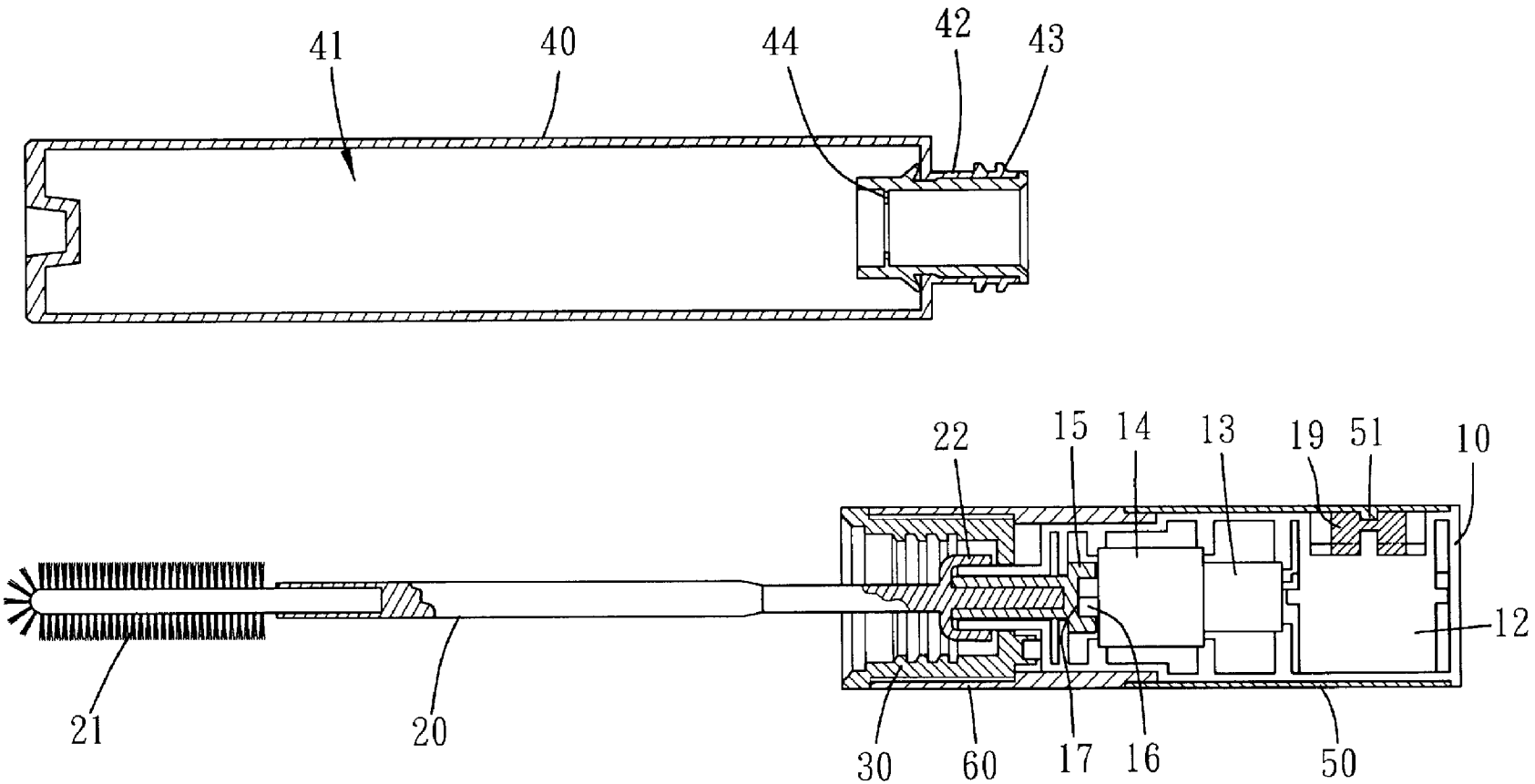
FIG. 3 is a breakdown profile showing a makeup applicator in accordance with a first embodiment of the present invention.

Please refer to FIGS. 1 to 4. In the first embodiment of the present invention, the leakproof makeup applicator includes a main body 10, a rod 20, a collar 30, a bottle 40 and a hand grip 50.

The main body 10 defines a receiving space therein and has a protrusive boss 11 extending from a front end thereof. The protrusive boss defines a bore communicating with the receiving space. The receiving space is installed with a power supply 12, which may includes one or more batteries, a motor 13, a reduction gearset 14 and a connector 15. The power supply 12 electrically connects to the motor 13, and the connector 15 is rotatably disposed in the bore of the boss 11 and is driven by the motor 13. The reduction gearset 14 is disposed between the connector 15 and the motor 13, so as to decelerate the rotating speed of the connector 15. Preferably, the reduction gearset 14 has a non-circular axle 16 extending therefrom, wherein the non circular axle 16 of the present embodiment is cross-shaped. The connector 15 is formed with a non-circular bore 17 to receive the axle 16 therein, wherein the non-circular bore 17 is also cross-shaped to correspond to the axle 16. Thereby, the reduction gearset 14 and the connector 15 are in a rotational operative relationship. The main body 10 may be further provided with a switch to selectively turn the motor 13 on or off. For instance, the main body 10 in the present embodiment defines a sliding groove 18 on its flank. A switch 19 is slidably disposed in the sliding groove 18 to switch the motor 13 on and off. In addition, the hand grip 50 is rotatably sleeved around the main body 10. The switch 19 in the present embodiment is plate shaped and has an arc outer surface. The outer surface is formed with a slanted groove 191. A protrusion 51 is formed on an inner periphery of the hand grip 50. The protrusion 51 is slidably inserts in the slanted groove 191. As such, the protrusion 51 slides along the groove 191 as the hand grip 50 is rotated with respect to the main body 10, so as to drive the switch 19 to move linearly on the sliding groove 18 and to further switch the motor 13 on and off.

The rod 20 has a first end and a second end. The first end thereof is connected to the connector 15. For example, the connector 15 may be formed with an inserting bore at a front end thereof for the first end of the rod 20 to insert therein, so that the connector 15 and the rod 20 can be in a rotational operative relationship. Or, the connector 15 and the rod 20 may be integrally formed. The second end of the rod 20 is provided with an applicator head 21, such as a mascara applicator head or a lip gloss applicator head.

The collar 30 is disposed at the front end of the main body 10. More specifically, the collar 30 has several fixation bores facing the main body 10, and the main body 10 has several fixation poles corresponding to the fixation bores. The fixation poles and bores are then mounted with each other to combine the collar 30 with the main body 10. Further, the collar 30 is formed with inner threads. In addition, an outer ring 60 may sleeve around the collar 30 to flush with the hand grip 50 for authentic and other purposes.

The bottle 40 defines a liquid chamber 41 and an opening 42 formed at one end of the bottle 40. More specifically, the bottle 40 has a neck where the opening 42 is defined. The liquid chamber 41 is for storing makeup liquid mixture, such as mascara or lip gloss. An outer periphery of the neck, i.e. the opening 42, is formed with outer threads to mate the inner threads of the collar 30. The opening 42 has a plastic ring 43 disposed on its inner periphery, and the plastic ring 43 defines a through hole. The rod 20 inserts into the liquid chamber 41 via the through hole. The plastic ring 43 has a neck portion 44 with smaller bore diameter so as to wipe excessive makeup liquid mixture off the applicator head 21.

Figure 4:
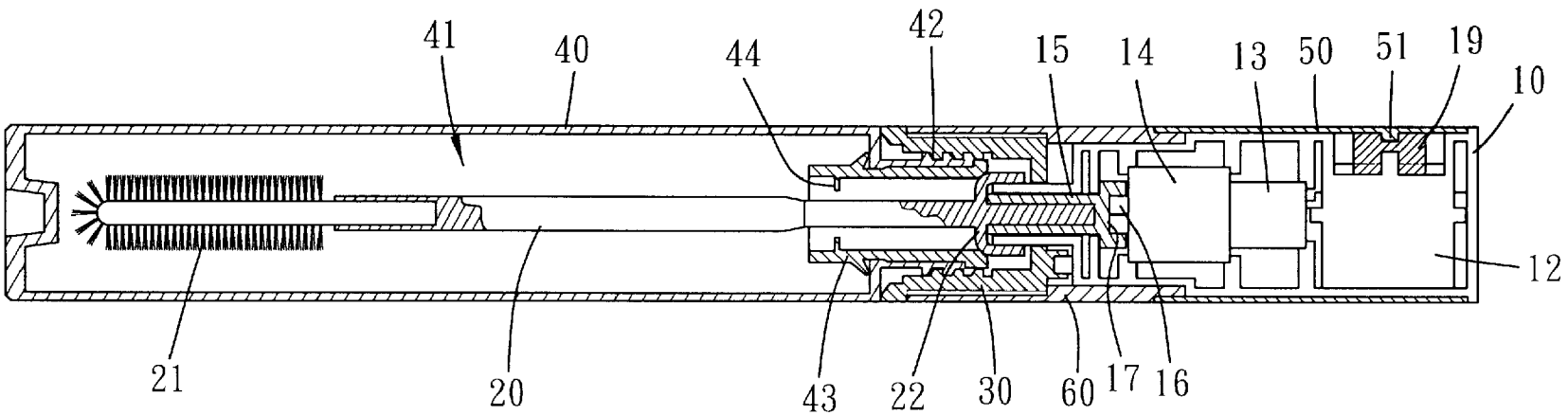
FIG. 4 is a profile showing a makeup applicator in accordance with a first embodiment of the present invention.
Figure 5:
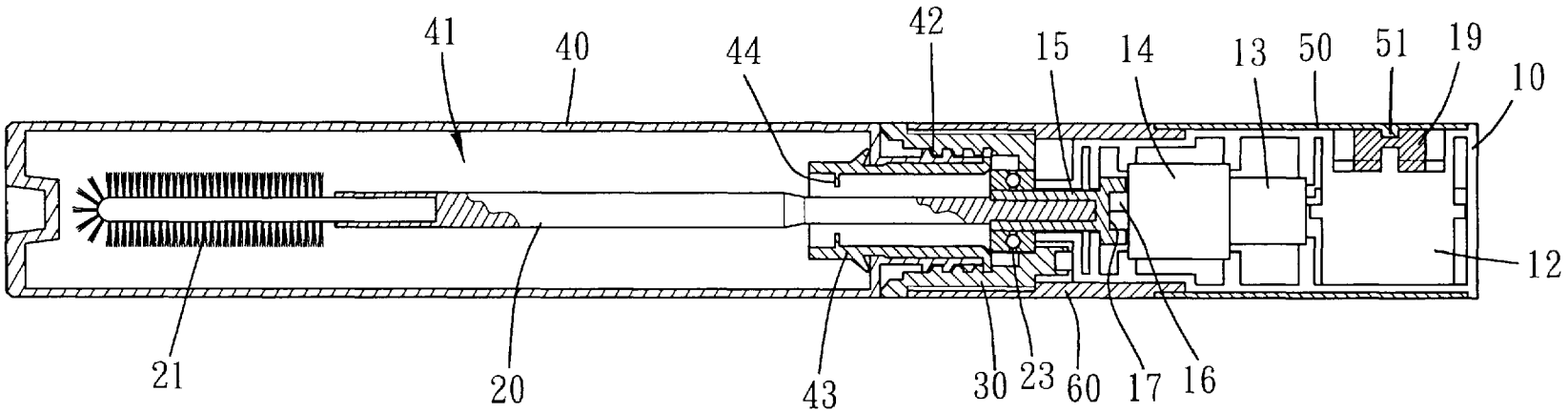
FIG. 5 is a profile showing a makeup applicator in accordance with a second embodiment of the present invention.

To prohibit the makeup liquid mixture leak into the gaps between rotatable elements, such as the rod and the connector, and the nonrotatable elements, such as the collar and the main body, the rod 20 is provided with a sealing sleeve, such as an umbrella skirt 22 and a ball shaped skirt. The umbrella skirt 22 exactly envelopes the protrusive boss 11 and the front end of the connector 15. The umbrella skirt 22 presses against the plastic ring 43 tightly and seals the through hole as the bottle 40 and the collar 30 are threadedly combined with each other as shown in FIG. 4. The liquid chamber 41 is, therefore, completely sealed so that the makeup liquid mixture would not leak. Further because the umbrella skirt 22 envelopes the protrusive boss 11 and the connector 15, the makeup liquid mixture adhered to the rod 20 will not fill the gap between the boss 11 and the connector 15 even when the rod 20 is drawn from the liquid chamber 41. In another embodiment as shown in FIG. 5, the sealing sleeve may be a bearing 23.

In summarization, the present invention has provided a solution to mitigate the malfunction disadvantage of conventional makeup applicators with rotatable rods, mainly because the makeup liquid mixture would have no access into the gaps between rotatable elements and nonrotatable elements. As such, the makeup liquid mixture will not coagulate between these elements nor cause the deprivation of the rotational function of the rod.

What is claimed is:

1. A leakproof makeup applicator, comprising:

a main body, defining a receiving space therein, a power supply, a motor and a connector being disposed in the receiving space, the power supply electrically connecting to the motor, the connector being driven by the motor to be rotatable with respect to the main body;

a rod, having a first end and a second end, the first end being connected to the connector concentrically, the second end being attached with an applicator head;

a bottle, defining a liquid chamber and an opening formed at one end thereof, the rod inserting into the liquid chamber via the opening;

wherein a sealing sleeve is disposed on the rod, and the sealing sleeve seals the opening as the bottle and the main body are combined with each other, wherein the connector and the rod are different pieces, the main body has a protrusive boss integrally extending from a front end thereof, the protrusive boss defines a bore communicating with the receiving space, the connector is rotatably disposed in the bore of the boss, and the sealing sleeve envelopes the protrusive boss and the front end of the connector.

2. The leakproof makeup applicator of claim 1, wherein a reduction gearset is disposed between the motor and the connector.

3. The leakproof makeup applicator of claim 1, wherein the main body defines a sliding groove on its flank, a switch is slidably disposed in the sliding groove to switch the motor on and off.

4. The leakproof makeup applicator of claim 2, wherein the reduction gearset has a non-circular axle extending therefrom, the connector is formed with a non-circular bore to receive the axle therein, whereby the reduction gearset and the connector are in a rotational operative relationship.

5. The leakproof makeup applicator of claim 1, wherein the applicator head is a mascara applicator head or a lip gloss applicator head.

6. The leakproof makeup applicator of claim 1, further comprising a collar disposed at a front end of the main body, the collar being formed with inner threads;

wherein an outer periphery of the opening is formed with outer threads to mate the inner threads of the collar, the opening has a plastic ring disposed on its inner periphery, the plastic ring defines a through hole, the rod inserts into the liquid chamber via the through hole, the sealing sleeve seals the through hole as the bottle and the main body are combined with each other.

* * * * *